United States Patent [19]

Heinrichs

[11] 4,447,796

[45] May 8, 1984

[54] SELF-ADJUSTING SPACER

[75] Inventor: Frank W. Heinrichs, McMurray, Pa.

[73] Assignee: McGraw-Edison Company, Rolling Meadows, Ill.

[21] Appl. No.: 365,347

[22] Filed: Apr. 5, 1982

[51] Int. Cl.[3] ..... H01F 27/08; H01F 27/30

[52] U.S. Cl. ..... 336/60; 174/17 SF; 336/196

[58] Field of Search ..... 174/17 SF; 336/58, 60, 336/92, 94, 196, 197, 198, 207

[56] References Cited

U.S. PATENT DOCUMENTS

| | | | |
|---|---|---|---|
| 2,036,068 | 3/1936 | Montsinger | 174/17 SF |
| 2,550,452 | 4/1951 | Byrne et al. | 174/17 SF |
| 2,886,791 | 5/1959 | Barengoltz | 336/197 |
| 2,934,726 | 4/1960 | Barengoltz | 336/192 |
| 3,085,315 | 4/1963 | Manning | 29/605 |
| 3,644,858 | 2/1972 | Galloway | 336/92 |
| 3,670,276 | 6/1972 | Theodore | 174/17 SF |
| 3,775,719 | 11/1973 | Gainer et al. | 336/58 |
| 3,789,337 | 1/1974 | Sheppard | 336/60 |
| 3,819,446 | 6/1974 | Suzuki | 156/291 |
| 3,979,552 | 9/1976 | Fisher | 336/58 X |
| 4,172,965 | 10/1979 | Eyestone et al. | 336/92 X |
| 4,173,747 | 11/1979 | Grimes et al. | 336/60 |
| 4,199,862 | 4/1980 | Gorton, Jr. et al. | 336/205 X |
| 4,219,791 | 8/1980 | Moore et al. | 336/58 |
| 4,243,623 | 1/1981 | Sprengling et al. | 264/272 |

OTHER PUBLICATIONS

"The Core-form Transformer-Designed for Strength," Wendahl et al., The Line 75/3, pp. 2-8.

*Primary Examiner*—Thomas J. Kozma
*Attorney, Agent, or Firm*—John S. Paniaguas; Jon Carl Gealow; James A. Gabala

[57] ABSTRACT

A unique design and method of construction is presented for a spacer and support suitable for use in maintaining one or more electrical conductors at a fixed distance from one another while permitting dielectric fluid to flow therebetween. The spacer is formed from two major parts: a foraminous container and a void filling means. The foraminous container defines a plurality of flow apertures around its periphery, and at either end, into which dielectric fluid is free to flow. The container is filled with a void filling means formed from a plurality of generally incompressible filler elements or nodules. The filler elements are packed into the container so as to maintain the correct spacing. The nodules or filler elements are sufficiently large that they remain confined within the container. Dielectric fluid fills the interstices between the void filling means and the container walls.

4 Claims, 12 Drawing Figures

SELF-ADJUSTING SPACER

TECHNICAL FIELD

This invention relates to electrical apparatus in general and more particularly to those insulating structures and members within electrical power transformers and the like which are used to separate or space apart one or more adjacent electrical conductors from each other or from other adjacent parts of the apparatus.

BACKGROUND OF THE INVENTION

In electrical apparatus such as power transformers, it is common to construct a magnetic core having cruciform or rectangularly-shaped leg members around which are wrapped a plurality of electrical windings each of which is composed of a plurality of layered conductor turns. Insulating structures of many shapes are used to physically separate the electrical conductors to prevent current transfer between adjacent electrical conductors and other electrically conducting members or parts of the apparatus. In addition, insulating structures are often used to form a void or open space between adjacent electrical conductors to facilitate cooling. These insulating "spacers" allow dielectric fluid to freely flow between the windings forming the transformer. The dielectric fluid therebetween provides additional insulation which is often required when the apparatus is to be operated at high voltages.

The arrangement and composition of the insulating structures which perform this spacing function depends largely upon the structural characteristics of the electrical apparatus and its voltage rating. In almost all electrical apparatus, the insulation structure must not only hold one electrical conductor at a spaced distance from another part or member but must also support one or more electrical conductors relative to the base or foundation upon which the windings are carried. Insulating structures which have mechanical integrity are particularly desirable in power transformers where conductor movement may be caused by excess forces such as those encountered when a transformer is subjected to a short-circuit load. A loose insulation structure not only permits movement of the conductors during a short-circuit condition but also permits movement due to thermal cycling and during shipping due to vibration.

In the case of a two-winding transformer, the low voltage winding is normally disposed adjacent one leg of the magnetic core with the high voltage winding wound around the low voltage winding. During a short-circuit condition, the low voltage and high voltage windings tend to separate, i.e. move in opposite directions. In particular, the low voltage winding is compressed against the leg of the magnetic core while the high voltage winding is subject to an outwardly directed radial force. As can be expected, considerable mechanical force is exerted against the spacers and other insulating structures between the windings. The force may be sufficient to pull the spacer out of position. This causes misalignment of the windings and (assuming the spacers are sufficiently distorted so as to change the distance or gap between the windings) a reduction of the insulated strength provided by the dielectric system.

According to the prior art, insulating structures or spacers are usually formed from solid insulated material such as pressboard of sufficient thickness to form a cooling duct or channel between adjacent windings. These spacer members are normally disposed so as to be flatly in contact with adjacent windings or the core support structure around which the windings are wound. During a short-circuit, there may be sufficient force or relative movement between the two windings such that the spacer is free to move out of alignment. If the spacer is held in place with an adhesive or mechanical connection, the force is often great enough to break the adhesive bonds or mechanical connection and pull the spacer structure against the windings, thereby resulting in misalignment of the spacers and the adjacent windings.

Heretofore, the windings of a transformer have been separated from the magnetic core legs and from adjacent windings by dowels which were wedged in place. These dowels are often arranged around a cruciformed rectangular core so as to form a generally cylindrical base structure. It is upon this structure that the electrical conductors were wound to form the windings of the transformer. The arrangements shown in U.S. Pat. Nos. 4,199,862; 4,173,747; and 3,789,337 are typical. It will readily be apparent by studying the foregoing patents that the problem of spacing apart one or more windings of an electrical apparatus or one or more of the electrical conductors of an electrical apparatus winding, in such a manner that adequate insulation and mechanical strength is provided, is a problem that has not been completely solved. Moreover, it should be clear that there is a long felt need for a solution to the problem of providing an efficient, low cost, mechanically strong spacer especially in view of the failure of so many others.

While dielectric fluid is necessary to provide adequate insulation and to provide adequate cooling, there are many locations within the apparatus where the dielectric fluid is not specifically needed for insulating or cooling purposes. This is particularly true when the tank or container in which the apparatus is housed is rectangular and the electrical apparatus within the tank has an ellipsoidal cross section. Various schemes have been devised to minimize, or reduce, the amount of fluid contained within the tank structure. Fisher (U.S. Pat. No. 3,979,552) recognized that earlier proposals and methods to reduce the amount of oil used in electrical apparatus had new meaning with the ever increasing price of petroleum products. Fisher's teachings were an advancement over those of Montsinger (U.S. Pat. No. 2,036,068). Montsinger suggested the replacement of a portion of the liquid coolant used in a transformer with spheres of fired clay. Fisher proposed a thermal insulating medium comprising a plurality of glass spheres having one or more closed voids. The glass spheres were sufficiently small such that they could occupy most of the available free space within the transformer tank. Glass beads were also proposed by Theodore in U.S. Pat. No. 3,670,276. Galloway (U.S. Pat. No. 3,644,858) taught the use of foam resin blocks to cushion the core-winding assembly of a transformer; in particular, a porous polyurethane resin was disclosed. More recently, Eyestone (U.S. Pat. No. 4,172,965) used a polyurethane encapsulate to provide an array of stacked coils in an inductive assembly.

This latter set of patents is distinguished from the earlier set of patents in that the latter is representative of structures which completely filled the void space between adjacent windings while the earlier set of patents described structures which space apart the windings at discrete locations. In addition, the latter set of patents teach arrangements which provide little, if any, structural support and which have the primary effect of displacing dielectric fluid.

Significantly, those skilled in the art have heretofore neglected the teachings exemplified in this latter set of patents in approaching the problem of designing an insulating support structure for electrical apparatus such as a transformer. There is no suggestion by any of these inventors of a method or apparatus which could combine these latter teachings in an insulating or spacing structure which can be positioned at discrete locations within the interstices of the transformer core structure to provide structural support, without significantly affecting the distribution of dielectric fluid. Discrete positioning of completely solid insulated members, whose width is small relative to the gap between adjacent members, has the effect of producing greater variances in temperature distribution and a less uniform electrostatic field. It would be especially desirable if: the temperature distribution and electrostatic field could be kept as uniform as possible; uniform support could be provided throughout the winding structure; more expensive or costly dielectric fluid could be displaced; and the resulting support structure could accommodate local mechanical distortions and rearrangements brought about by vibration or short circuiting of the windings without disrupting coolant flow or the arrangement of the windings. A device having all of these benefits and advantages, which could be easily adapted to existing transformer designs, and which is relatively inexpensive and easy to install would be widely accepted by the industry.

SUMMARY OF THE INVENTION

In accordance with the present invention, an insulating structure or spacer (and a method of construction) is provided to separate and support one or more electrical conductors which are immersed in an dielectric fluid such that the electrical conductors will be held apart, at a spaced distance, while minimizing the amount of dielectric fluid required to achieve an insulating effect and while disturbing the local electromagnetic field to the minimum extent possible. Specifically, a spacer is disclosed formed from a container and a void filling means which is packed within the container. The container is formed from a porous or open structure fabric or material which is generally impervious to the dielectric fluid and which retains its flexibility when the spacer is placed in service. Materials formed from high temperature plastic fabric or cellulose are suitable. High insulating strength, although desirable, is not required. The void filling means comprises a plurality of particles or members which are sufficiently large to be kept within the container, yet sufficiently small so that they can be easily poured within the container and packed to fill the container thereby holding the windings or electrical conductors apart.

The void filling means, in one embodiment, is formed from packing spheres made from insulating material, such as plastic or glass, which is generally incompressible. These packing spheres are poured into the container and packed into place by vibration or agitation. Because of the size of the packing spheres or void filling means relative to the volume of the container, dielectric fluid is free to fill the interstices of the void filling means and the adjacent electrical conductors. The containers may be clustered about one another so as to form shapes of various sizes or they may be spaced apart so as to form generally discrete spacer members. In one embodiment one container is disposed in the space between two concentric windings of a transformer. Thus, the void filling means completely occupies the region between the two windings and keeps the two windings apart. In still another embodiment, the container is formed by two adjacent concentric insulating sheets or members which surround one of the legs of the magnetic core. After blocking the lower end of the annular space or region formed by the two insulating members with a perforated cap or plug, the void filling means is poured into the annular region and packed to achieve the desired spacing between the two insulating members. The other end of the annular region is then capped with another perforated plug. This latter embodiment is particularly advantageous in that it uses the two insulating sheets which are ordinarily present in most core-form transformer designs. In another embodiment, an insulating sheet and the core itself are used to form the walls of the container for the void filling means.

Numerous other advantages and features of the present invention will become readily apparent from the following description of the invention and its various embodiments, from the claims, and from the accompanying drawings.

DETAILED DESCRIPTION OF THE INVENTION

Figure 1:
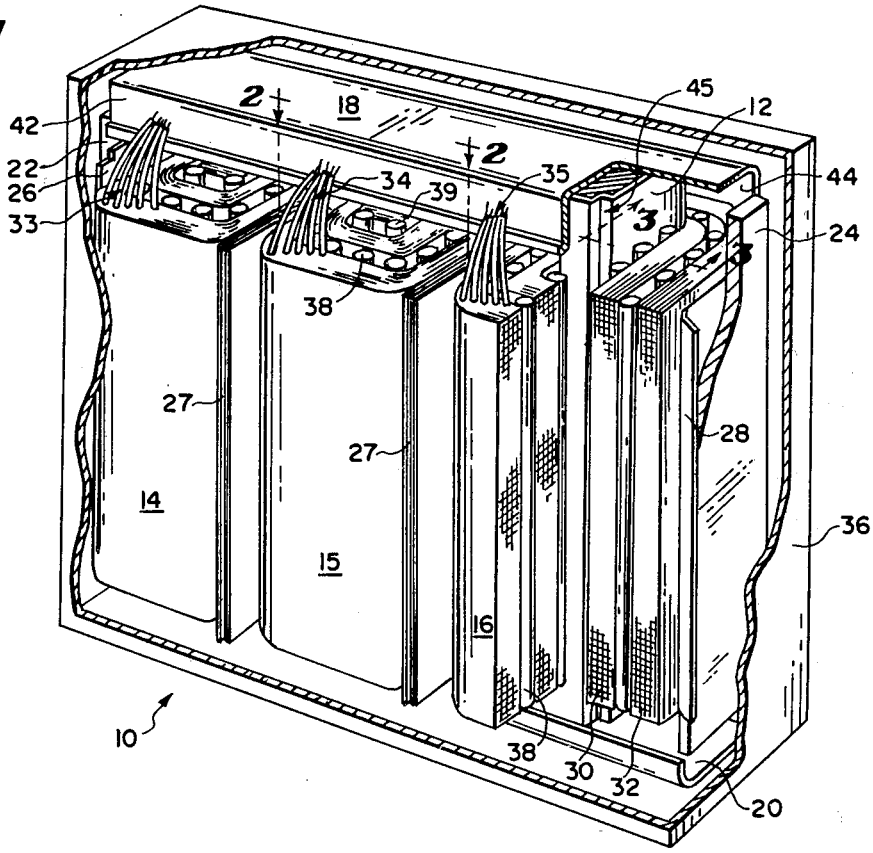
FIG. 1 is a cross-sectional, perspective view of an electrical apparatus, a three-phase power transformer, incorporating the winding and insulation support means or spacer that is the subject of the present invention.

While this invention is susceptible of embodiment in many different forms, there are shown in the drawings, which will herein be described in detail, several preferred embodiments of the invention. It should be understood, however, that the present disclosure is to be considered as an exemplification of the principles of the invention and is not intended to limit the invention to any of the specific embodiments illustrated.

Referring now to the drawings, and to FIG. 1 in particular, there is shown a power transformer 10 having a laminated magnetic core 12 and three winding structures 14, 15, and 16. An end frame having a top support 18, a bottom support 20 and two side braces 22 and 24 is positioned around a magnetic core 12. Insulating barriers 26, 27, and 28 are located between adjacent winding structures 14, 15, and 16 and the two side braces 22 and 24. Those skilled in the art will understand that, although the transformer 10 shown in FIG. 1 has the windings wrapped around the central core (a core-form transformer), the invention is equally applicable to shell-form transformers and transformers of the "pancake variety" whether of core-form or shell-form design. In a pancake core-form transformer, disk shaped coil sections are stacked concentrically around the legs of the magnetic core. Under such an arrangement the spacers to be described not only may be used to keep adjacent coils at the proper distance, but also may be used to support the coil sections one above the other.

Each winding structure 14, 15, and 16 includes a plurality of turns of an electrical conductor with suitable insulation disposed between adjacent turns. It is conventional practice for each winding structure to include at least a primary winding 30 and a secondary winding 32. Lead groups 33, 34, and 35 provide means for connecting the winding structures 14, 15, and 16 to other components of the transformer 10, such as bushings mounted on the transformer casing or tank 36. The laminations of the magnetic core 12 are secured by the top support 18 and the bottom support 20 by overlapping portions 42 and 44 which are pressed together against the core. Insulation material usually in the form of strips or sheets, is placed between the core 12 and the core supports (not shown for purposes of clarity). Additional details concerning the matter in which large power transformers are assembled are set forth in U.S. Pat. Nos. 2,886,791, 2,934,726, and 3,085,315 which for purposes of description are hereby incorporated by reference and assigned to the assignee of the present invention.

Figure 2A:
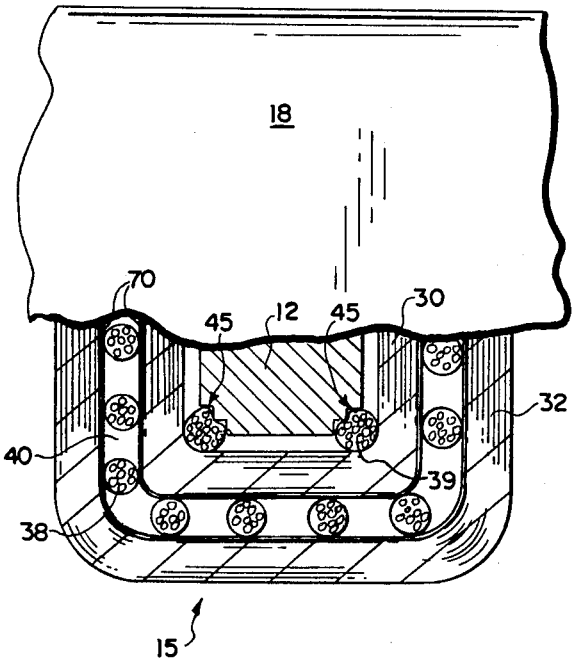
FIG. 2A is a partial, cross-sectional plan view of the transformer structure shown in FIG. 1 as viewed along line 2—2. Here the enclosures which house the packing spheres are distributed at spaced intervals between two windings of the transformer.

FIG. 2A is a partial top view of the transformer 10 shown in FIG. 1 illustrating the detail of one winding structure 15 with the lead group 34 eliminated from the figure in the interest of clarity. The winding structure is formed from a plurality of turns or turn groups which are disposed generally concentrically around one leg 12 of the magnetic core. In this particular case, the low voltage winding 30 is disposed adjacent the core 12 while the high voltage winding 32 is disposed along the exterior of the low voltage winding. Many other arrangements are possible and are known to those skilled in the art.

In FIG. 2A the high voltage winding 32 is separated from the low voltage winding 30 by a plurality of spacers 38. These spacers 38 serve two functions. With respect to the low voltage winding 30 and the high voltage winding 32, the spacers hold the two windings apart and provide a channel or passageway 40 through which dielectric fluid, such as ordinary transformer oil, is free to flow. The dielectric fluid improves the insulative effect which would otherwise occur if the two windings were merely spaced apart with air therebetween. With respect to the core 12, the spacers 39 (physically the same as those denoted by 38) facilitate wrapping the conductors which form the low voltage winding 30 about the core so as to account for the squared off edges 45 defined by the laminations of the core 12. In FIG. 2C, the spacers 39' are clustered about each other, while the spacers 39, in FIG. 2A are spaced at intervals from each other. Although FIG. 2A shows the spacers 38 between the low voltage winding 30 and the high voltage winding 32 located at a fixed interval from each other, the individual spacer elements may be clustered together to produce whatever separation is required.

Figure 3:
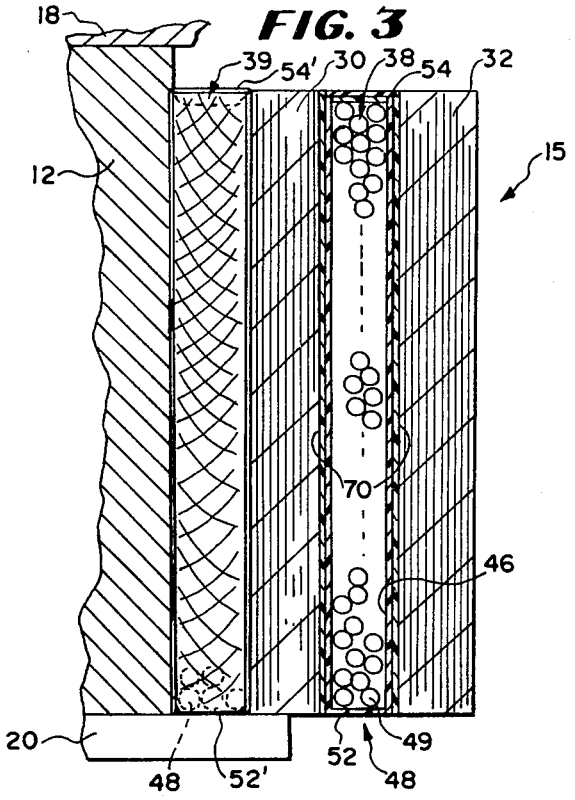
FIG. 3 is a partial, cross-sectional, side elevational view of the transformer winding and winding support structure shown in FIG. 1 as viewed along line 3—3.

A cross-sectional, elevational view of the transformer 10 shown in FIG. 1 is shown in FIG. 3. Each spacer has two major parts or components: a tube-like container or sleeve 46 which is plugged or capped at each end; and a void filling means 48 in the form of a plurality of generally solid filler elements or nodules 49. Each of the nodules 49 is sufficiently large so as to be confined within the container 46, and defines a total volume less than the interior volume of the container. A plurality of interstices is formed between the nodules 49 and is filled with the dielectric fluid. Before describing the materials from which the container 46 and void filling means 48 can be formed, the general shape and configuration of these two major components will be described in greater detail.

Figure 4A:
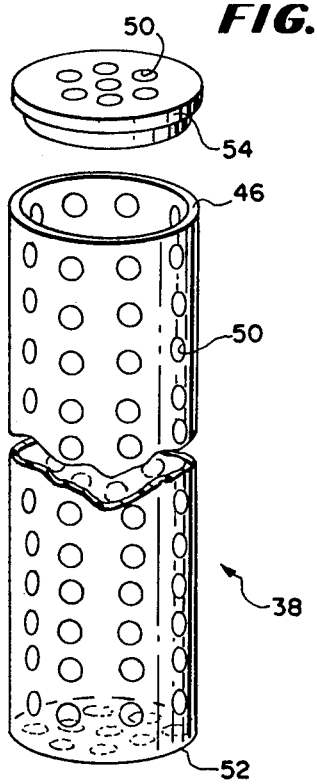
FIG. 4A is a pictorial representation of one embodiment of the enclosure or sleeve, which houses the packing spheres, shown with a perforated cap at one end.

FIG. 4A illustrates a generally cylindrical container 46, the walls of which define a plurality of flow apertures 50. These flow apertures are sufficiently small, relative to the size of the filler elements or nodules 49, that the filler elements will be confined to the interior of the container 46. In FIG. 4A the lower end of the container has an integral, perforated, bottom cap or plug 52 and a separate removable top cap or plug 54. The perforations in the bottom cap 52 and top cap 54 facilitate venting and filling of the container 46 when the transformer tank 36 is filled with dielectric fluid.

Figure 4B:
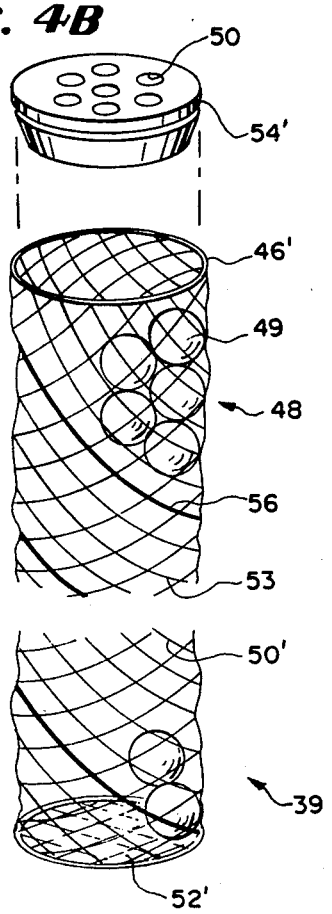
FIG. 4B is an alternate embodiment of an enclosure used to house the packing spheres.
Figure 4C:
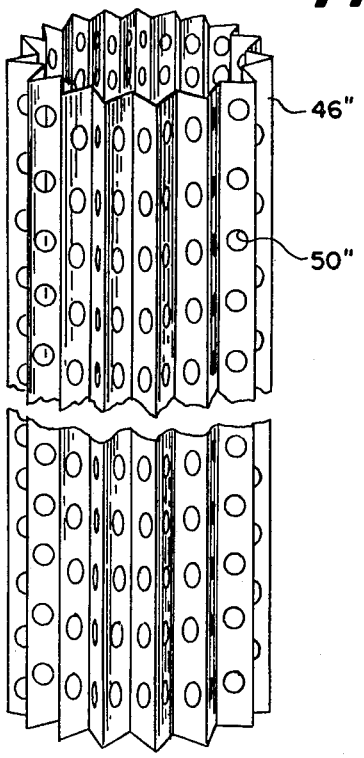
FIG. 4C is still another embodiment of an enclosure which houses the packing sphere.
Figure 4D:
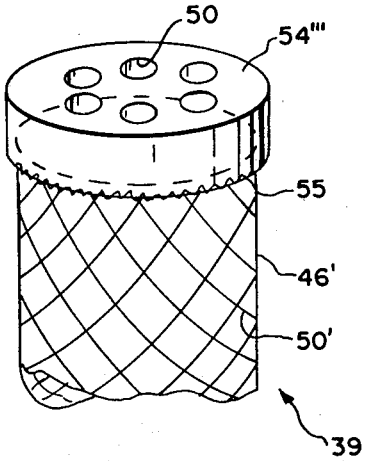
FIG. 4D is a pictorial view of a semi-rigid cap suitable for use with the flexible sleeve enclosure shown in FIG. 4B.

The thickness of the walls of the container 46 has some effect on its overall rigidity. A container 46 formed from solid material is self-supporting or generally self-erecting even without the presence of filler elements. The overall rigidity of the container may be enhanced by using the structure shown in FIG. 4C. There the container 46'' has walls, formed from relatively thin material, which are folded in a generally accordian-like arrangement. In FIG. 4B the container 46' is formed from a mesh or net-like material. Because of the thinness of the material, the container 46' is and is not self supporting. The container 46' resembles a sock-like bag or tube. The individual strands 53 forming the walls of the container define a plurality of foramina or flow appertures 50'. Like the container 46 shown in FIG. 4A, the bottom cap 52' may be formed integral with the walls of the container and a separate top cap 54' may be used. Of course, the bottom end could be plugged with a cap similar to top cap 54'. In FIG. 4D the upper end of the container 46' is plugged with a top cap 54''' which is generally solid or rigid having lower portions which are joined to the upper end of the container 46' by a process such as stitching 55. FIG. 4F illustrates an embodiment wherein the upper end of the container 46' is plugged with a cap 54'' made from the same mesh-like material as the walls of the container. In FIG. 4F the top cap 54'' may be joined to the main body or walls of the container by stitching 55.

If the walls of the container are essentially rigid, the space or distance between adjacent windings, maintained by the spacers 38, will be determined by the compressive strength of the filler elements 48 and the hoop strength of the container walls. If the walls of the container are generally flexible, the filler elements will be relatively free to rearrange themselves relative to one another within the container. In FIG. 4B the walls of the container 46' are laced or strung with an elastic cord 56. This tends to keep the filler elements somewhat more closely packed together and tends to maintain the spacing between adjacent windings generally constant despite the effects of vibration and thermal transients. The elastic cord 56 produces a container 46' which has a rigidity intermediate between one having completely solid walls (e.g. FIG. 4A) and one formed from a net-like mesh. The elastic cord 56 can also be added to the net-like cap 54'' shown in FIG. 4F. Here the elastic cording will tend to force the filler elements downwardly toward the interior of the container 46'.

Figure 2B:
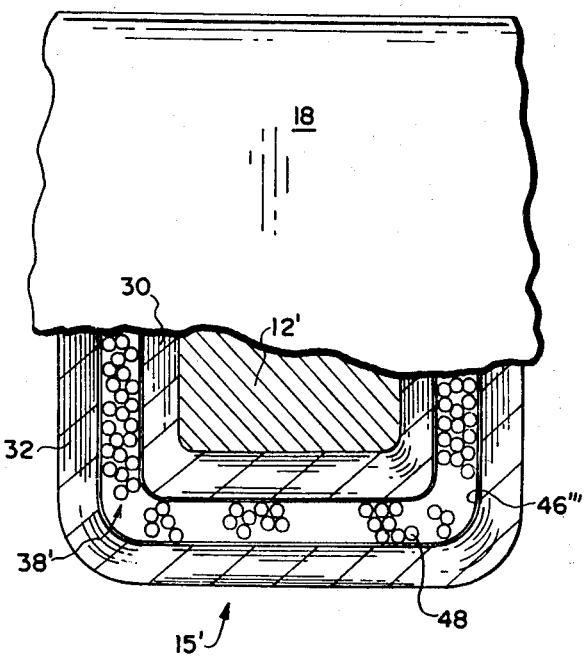
FIG. 2B illustrates the same view as in FIG. 2A with an alternate embodiment of the invention installed. Here the packing spheres or void filling means are distributed more or less continuously between two windings of the transformer.
Figure 4E:
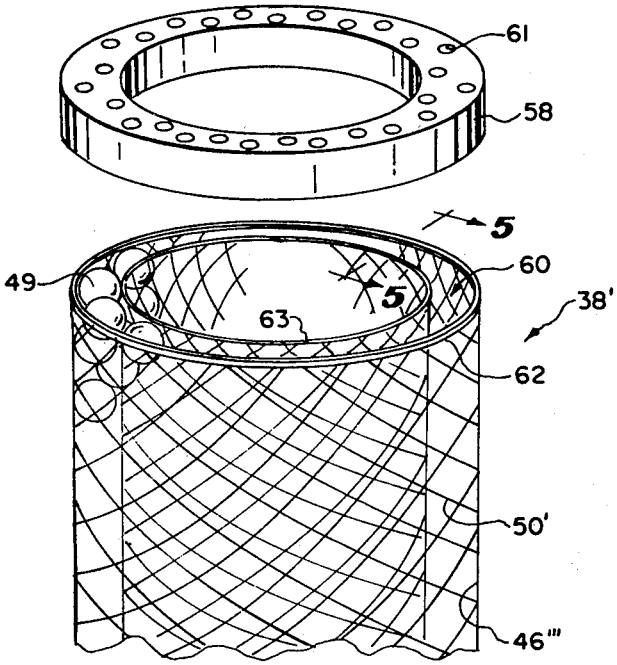
FIG. 4E illustrates a packing sphere enclosure having two concentric walls and an annular cap.
Figure 5:
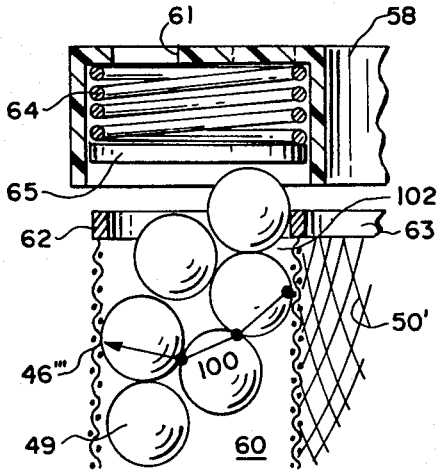
FIG. 5 is a partial, cross-sectional, side elevational view of the sleeve shown in FIG. 4E as viewed along line 5—5.
Figure 4F:
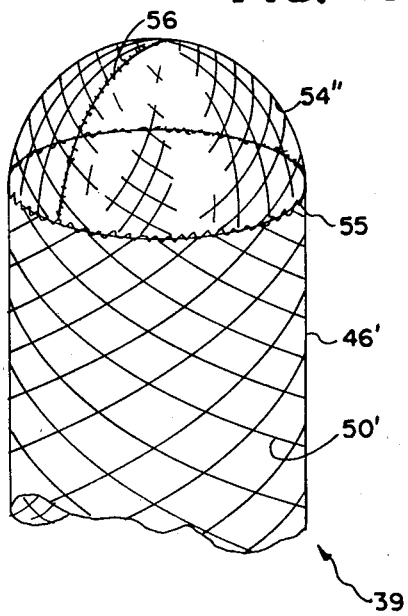
FIG. 4F illustrates the sleeve shown in FIG. 4B with a cap of an alternate embodiment.
Figure 2C:
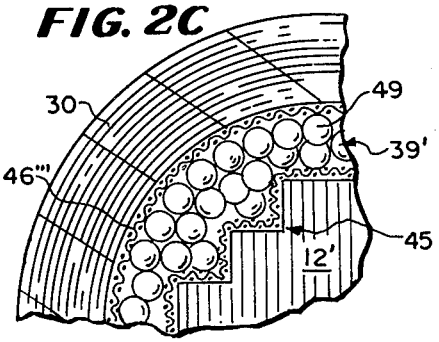
FIG. 2C is a partial, cross-sectional, plan view of one quadrant of a winding structure wherein the tubes or sleeves which house the packing spheres are disposed between the core and the adjacent set of windings.

FIGS. 2B, 4E, and 5 illustrate still another embodiment of the spacer that is the subject of the present invention. Here the spacer 38' has two generally cylindrical concentric walls which define a hollow annular region 60 into which the filler elements 48 are packed. The upper end of the annular container 46''' is plugged or capped with a ring-shaped cap 58. The upper end of the container 46''' can be provided with two continuous bands or rim elements 62 and 63 to facilitate joining the cap 58 to the container 46'''. The ring-shaped cap defines a plurality of flow apertures 61. FIG. 2B illustrates the situation where the spacer 38' is located between two windings 30 and 32 of a core-form transformer 10. Here, the container 46''' completely fills the space or channel between the two windings.

A spacer of this general shape can also be located between one of the windings and the core 12. This latter arrangement is illustrated in FIG. 2C. In large power transformers, the core legs 12' may not be perfectly rectangular. The core legs are typically formed from a plurality of laminations that diminish in width in stepwise fashion. This stepwise arrangement of the laminations results in corners or edges 45 which must be provided with filler rods or strips to round out the edges. FIG. 2A illustrates a single spacer 39 positioned adjacent such a stepped edge or corner. In FIG. 2C, the spacer 39' wraps around the core leg 12' and smooths out the stepped edges. In each case, the effect is to produce a generally cylindrical structure or form upon which the adjacent winding 30 can be wrapped.

Referring to FIG. 2C, it should be appreciated that when a set of windings 30 are wrapped fully around the core 12, an annular region or space is formed which is opened only at the upper and lower ends. Thus, the installation of perforated caps at the upper and lower ends of the space will maintain the filler elements in place without using a separate foraminous container 46'''. Depending upon the overall size of the transformer, and the space between insulated portions 70 of adjacent windings or between the innermost winding 30 and the core 12, this construction may prove to be more useful, and should be considered as still another, if not the preferred embodiment. It should be understood that when the windings are arranged in pancake fashion around the core, the vertical distance between adjacent disk elements can be selected to be sufficiently narrow that the packing spheres or filler elements will be retained in place adjacent the windings of the transformer without using a separate housing. It should also be understood that separate caps need not be provided; other structural members of the transformer, if placed sufficiently close to the ends of the annular region can function as caps to block the release of the filler elements.

FIG. 5 illustrates a device which may be used to maintain the void filling means 48 closely packed together. Specifically, the upper end of the top cap 58 contains a spring 64 and a piston 65. The spring 64 biases the piston 65 downwardly against those packing spheres or filler elements 48 at the upper end of the container 46'''. The spring 64 serves much as the elastic bands or cords 56 shown in FIG. 4F. However, neither the springs nor the elastic cords are essential to the practice of the invention.

Regardless of which specific embodiment is used, the net effect is that the inner or low voltage winding 30 strengthens the outer or high voltage winding 32 (and vice versa), while enabling fluid to flow freely between two windings when the transformer 10 is in operation.

Turning to the materials which may be used, the individual filler elements 49, used in a power or distribution class transformer, are preferably formed from an insulating material such as plastic, glass, wood, or minerals having a compressive strength of at least 2000 PSI. The filler elements are preferably spherical in shape, although irregularly shaped nodular-like elements may be used. Spherical shaped elements may be more conveniently poured into the container and packed into position. Packing spheres having a diameter from $\frac{1}{8}$ to $\frac{3}{4}$ of an inch can be conveniently used with a container having apertures at least 1/32 of an inch in diameter (e.g. a 1/36 inch mesh size in the case of the container illustrated in FIG. 4B). When the solid insulating material has a dielectric constant nearly the same as that of the dielectric fluid (e.g. transformer oil, typically 2.0 to 2.7), the electrical voltage stress is more uniform and neither the dielectric fluid nor the solid electrical insulation is subjected to a disproportionate voltage gradient. The containers 46 themselves may be formed from any porous open structure fabric that is inpervious to the dielectric or which maintains its overall flexibility and insulating strength despite long-term immersion in a hot dielectric fluid. Plastic fabric and celluosic materials are generally suitable materials for the containers. The filler elements are poured into the container and preferably packed tightly in place by vibration or agitation.

From the foregoing it should be appreciated that the arrangement of filler elements shown in FIG. 2B forms a structure having a plurality of load supports between adjacent windings or between a winding and the center core (see FIG. 2C): This structure transmits mechanical forces, such as those experienced during a short circuit, uniformly between the windings or between the winding and the adjacent core thereby reducing the peak forces which can be exerted on these structures. Moreover, this is achieved while permitting a comparatively greater amount of relative movement than would be experienced if solid spacers were used. There are other advantages:

a. The spacer elements can be easily located and moved while the transformer is being assembled. In contrast, a solid spacer is generally custom fitted for a relatively specific location;

b. When spherical filler elements are used, maximum strength is achieved with minimum contact area between adjacent windings or between the winding and the core. This facilitates the free flow of dielectric fluid and enhances the amount of cooling achieved while using comparatively little fluid;

c. The flow of fluid is relatively uninterrupted compared to those transformers using a solid filler materials;

d. The dielectric strength in the fluid-filled space is improved due to the formation of relatively random-oriented, elongated, broken straight line, solid paths (see broken arrow 100 in FIG. 5) and due to the formation of uninterrupted, reduced size, continuous, fluid-filled spaces 102 (see FIG. 5);

e. In the case of a transformer application, optimum packing of the filler elements is maintained during service by the natural vibration induced by the alternating current flowing through the transformer windings and the effect of gravity in maintaining the filler elements biased in the downward direction;

f. A very tight mechanical fit is obtained which is easily adjustable to account for specific local situations and peculiarities such as differences in winding size and material; and g. The volume of dielectric fluid is reduced without significantly affecting the overall cooling capacity of the fluid or the insulative strength of the volume occupied by the fluid.

Thus, it should be apparent that a unique spacer and a method of separating electrical windings or conductors has been provided. The method and the spacer itself are readily adaptable to conventional design practices and manufacturing techniques without requiring a complete redesign of the basic electrical apparatus or without extensive training of those persons who construct the device. Moreover, while the invention is described in conjunction with several specific embodiments, it should be evident that there are many alternatives, modifications, and variations which will be apparent to those skilled in the art in light of the foregoing description. For example, although the transformer 10 shown in FIG. 1 is a three-phase core-formed transformer, the teachings of the invention may be applied to any single or multi-phase power transformer or electrical reactor, circular or rectangular, core-form or shell-form, wherein one or more windings or electrical conductors must be kept at a spaced distance from another. Accordingly, it is intended to cover all such alternatives, modifications and variations as set forth within the spirit and broad scope of the appended claims.

What is claimed is as follows:

1. In an electrical apparatus of the type having a first electrical conductor and a second electrical conductor immersed in dielectric fluid, a spacer comprising:

a. a container, defining a first volume and a plurality of flow apertures, interposed between the first conductor and the second conductor; and b. void filling means disposed within said container, said void filling means comprising a plurality of elements whose total volume is generally less than said first volume, said void filling means defining a plurality of interstices;

whereby the fluid fills said interstices and the electromagnetic field between said conductors in the vicinity of said container more represents the electromagnetic field which should exist if said void filling means were absent.

2. The apparatus set forth in claim 1, wherein said container is generally flexible and non-self supporting in the absence of said void filling means.

3. The apparatus set forth in claim 1, wherein the first electrical conductor is the core of a core-formed transformer, the second electrical conductor forms a winding of said transformer, and said container is made from insulating material.

4. The apparatus set forth in claim 1, wherein the first and second electrical conductors form the primary and secondary windings respectively of a transformer.

* * * * *